United States Patent [19]

Boyer et al.

[11] Patent Number: 4,933,548

[45] Date of Patent: Jun. 12, 1990

[54] METHOD AND DEVICE FOR INTRODUCING SAMPLES FOR A MASS SPECTROMETER

[75] Inventors: Robert Boyer, Pierrelatte; Jean-Pierre Journoux, Piolenc; Claude Duval, St Paul Trois Chateaux, all of France

[73] Assignee: Compagnie Generale des Matieres Nucleaires, France

[21] Appl. No.: 284,346

[22] Filed: Dec. 14, 1988

Related U.S. Application Data

[63] Continuation-in-part of Ser. No. 10,133, Dec. 24, 1986.

[30] Foreign Application Priority Data

Apr. 24, 1985 [FR] France ..... 85 06257
Mar. 25, 1988 [FR] France ..... 88 03971

[51] Int. Cl.[5] ..... H01J 49/04
[52] U.S. Cl. ..... 250/288; 250/425
[58] Field of Search ..... 250/288, 425

[56] References Cited

U.S. PATENT DOCUMENTS

Re. 26,392 5/1968 Craig et al. ..... 250/288
3,888,107 6/1975 Langer et al. ..... 250/425
4,495,414 1/1985 Barrie et al. ..... 250/288

OTHER PUBLICATIONS

Blanchard et al., Canadian Journal of Chemistry, vol. 37, 1959, pp. 515–519.

*Primary Examiner*—Jack I. Berman
*Attorney, Agent, or Firm*—Larson and Taylor

[57] ABSTRACT

The device allows microsamples to be introduced into the ionization source of the spectrometer. It includes a reactor with means for introducing the microsample, means for heating the microsample, means for connection with a vacuum source and means for feeding an adjustable flow of reagent for transforming the microsample into gaseous compounds; a restricted and calibrated passage for flow of the gases from the reactor; and a sublimation tube connected on the one hand to the passage and, on the other, to the ion source of the spectrometer through a valve having means for bringing it to an adjustable cryogenic temperature.

10 Claims, 3 Drawing Sheets

FIG. 3.
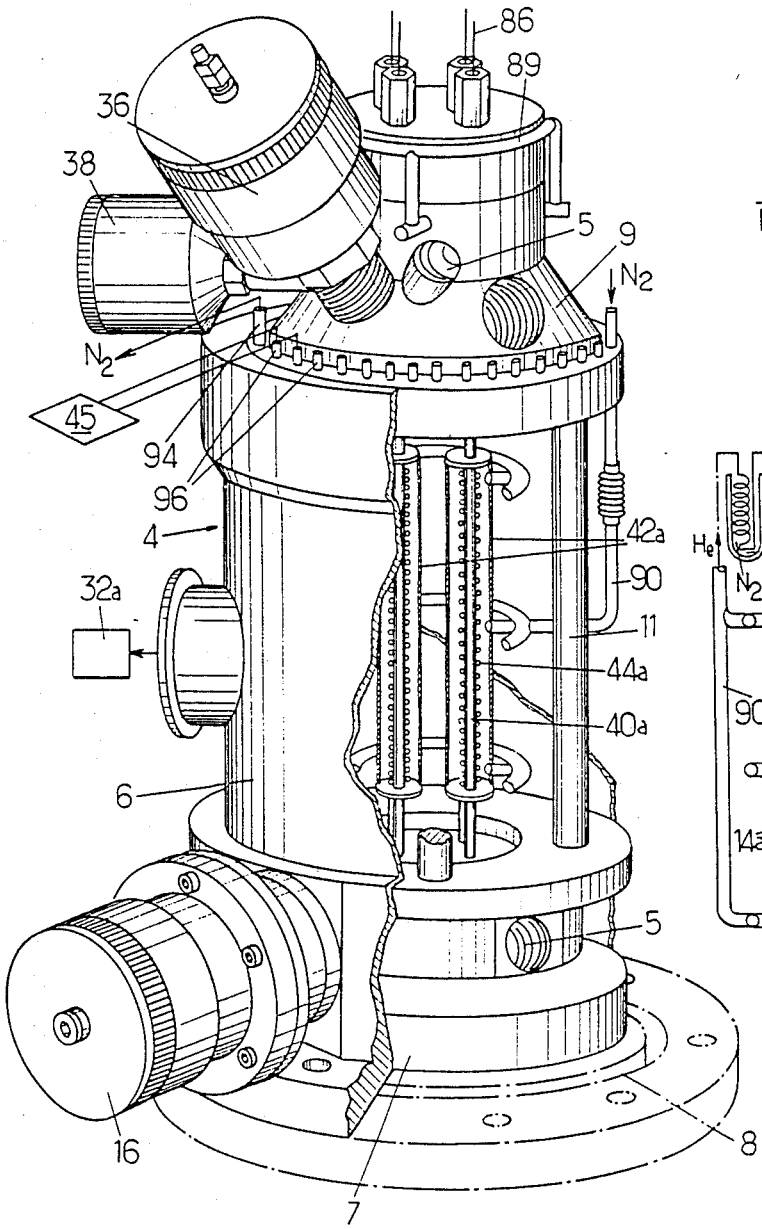
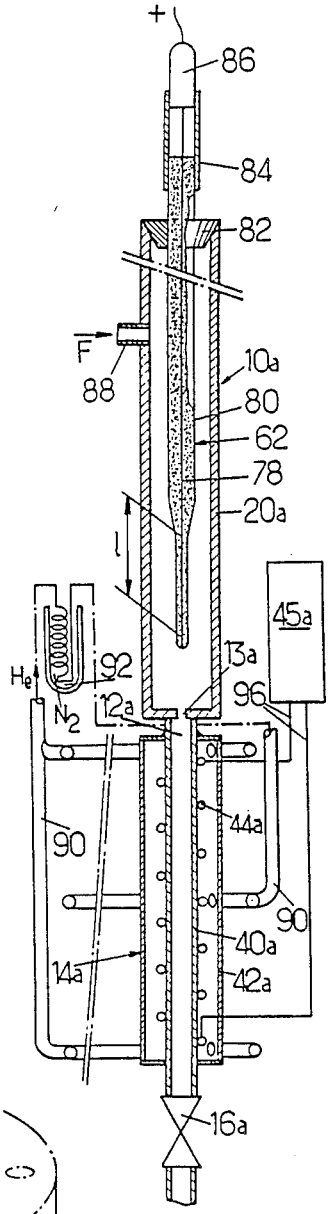
FIG. 4.

METHOD AND DEVICE FOR INTRODUCING SAMPLES FOR A MASS SPECTROMETER

CROSS-REFERENCES TO RELATED APPLICATION

This application is a continuation-in-part of co-pending application No. 010,133 filed Dec. 24, 1986 in the name of Robert Boyer et al.

BACKGROUND OF THE INVENTION

1. Field of the invention

The invention relates to the field of mass spectrometry sample analysis and it has more particularly as object the methods and devices for introducing a microflow of a sample whose ions are subjected to analysis into the mass spectrometer.

It finds a particularly important application in the field of isotopic analysis, which must often be carried out on small sized samples, for example because these samples are highly radioactive or particularly costly.

Prior Art

At the present time, mass spectrometers use either a thermo-ionic ion source, or an ion source with electronic bombardment of a gas flow.

The first solution has the advantage of allowing samples to be used of very small mass, frequently between 0.1 and 1 microgram. The sample, usually in liquid form, is deposited on a refractory metal ribbon. By evaporation of the liquid, a solid deposit is obtained. The ribbon is placed in the ion source of the apparatus, then heated to a high temperature (2600° C. for example) by an electric current. The sample then emits neutral molecules and ions. These latter, accelerated and focused in the form of a particle beam, are subjected to the analysis.

Although this technique has the advantage of allowing very small amounts of samples to be used, it has on the other hand numerous drawbacks. The intensity of the ion currents obtained at the collector of the spectrometer is low: that implies in practice being able to measure currents as small as $10^{-17}$ amps, which requires multipliers. The emission of ions by thermoionization is not well known, its stability and evolution in time are not always perfectly mastered. It is necessary to take into account isotopic fractionation and mass discrimination effects by corrections, generally provided by calibrating the apparatus with known products. Stable and reproductible measurements can only be obtained by accurately controlling the purity of the sample, the method of its preparation and deposition, the purity of the refractory forming the support, the degassing, the temperature rise rate.

All these limitations mean that it cannot be expected to exceed an accuracy of about 1:1000 when the isotopic ratios in the sample are of the order of 1/200, which is current in the nuclear field.

In addition, a mass spectrometer using a thermo-ionic source cannot be used for conducting chemical composition analyses and it is difficult to connect it in line in a separation or processing line.

Some of the above-mentioned drawbacks of the thermo-ionic sources do not exist in electron bombardment sources, which are wider in their application since they allow not only chemical but also isotopic analyses, but imply that the sample to be analyzed is gaseous or readily vaporizable.

The usual method consists in introducing the sample from a sealed container through ducts and microleak valves letting through a well determined and very small gas flow as as not to alter the very low pressure which must reign in the analyser of the spectrometer. The gas or vapor molecules which pass in a very small amount are subjected to the action of an electron beam of predetermined energy which ionizes the gas so as to give rise to ions subjected to the analysis.

The intensity of the ionic currents obtained is usually of the order of $10^{-9}$ A, that is to say much higher than in thermo-ionization spectrometers, which simplifies the measurement.

Since it is possible to retain the vacuum in the source for introducing the sample, contrary to what happens in the case of a thermo-ionic source and since the time before stabilization is shorter, the time required for obtaining a result is reduced as a whole by a factor of about 4, which makes the apparatus usable in line.

As a counterpart to the above-mentioned advantages, electron bombardment sources have drawbacks which make them difficult to use in certain cases.

In particular, it is necessary to have samples of a larger size than in the first case and to handle them. It is in fact not known how to design sample bottles, transfer volumes and valves having internal capacities less than a few cubic centimeters. In addition, the interaction of the gas molecules with the walls which contain them causes memory phenomena to appear which influence the results of the measurements and require corrective factors to be taken into account, determined from consumable standards.

In other words, the measurements carried out by means of a spectrometer using an ion source by electron bombardment are as a general rule differential measurements which guarantee a high accuracy, typically 50 to 100 times higher than with a thermo-ionization source.

It can be seen that each of the known solutions has drawbacks which make it unsuitable for a number of applications. In particular, the ion sources using the ionization of a small molecular flow require large sample volumes, which represents a serious or even redhibitory constraint in some cases.

SUMMARY OF THE INVENTION

It is an object of the present invention to provide an improved method and device for supplying a mass spectrometer using the technique of ionization of a very small flow, typically by means of an electron beam; it is a more specific object to allow samples to be used of a very small mass.

To this end, the invention proposes more particularly a method of introducing microsamples in gaseous form in the ionization source of the mass spectrum, in which method the sample is transformed into a gaseous compound by heating in an atmosphere of a reactive gas, a flow of the compound and of the reactive gas is organized as a molecular flow towards a wall kept at a sufficiently low temperature for trapping the gaseous compound and the reagent and the gaseous compounds are selectively released by controlling the temperature of said wall.

There is also provided a device for introducing microsamples in the ionization source of a mass spectrometer including a reactor with means for introducing the microsample, means for heating the microsample, means for connection with a vacuum source and means for feeding an adjustable flow of reagent for transforming the microsample into gaseous compound; a restricted and calibrated passage for the flow of gases from the reactor; a sublimation tube connected on the one hand to the passage and on the other hand to the ion source of the spectrometer through a valve, having means for bringing it to an adjustable cryogenic temperature.

It can be seen that with this device the apparatus keeps all the advantages of using an electron bombardment which simplifies measurement thereof; it avoids breaking the vacuum in the source for introducing the sample; it is not necessary to have sealed containers for handling the samples and connecting them to the device.

Furthermore, compared with the conventional device for electron bombardment spectrometer, the device proposed has numerous advantages: the size of the samples to be analyzed may be as small as a few micrograms; it is not necessary to have sealed containers for handling the samples and introducing them into the device; the consumption of standards or reference products may be reduced to the order of size of that of the samples, whose preparation is simple and rapid.

In addition, several devices may be readily placed at the input of the electron bombardment ion source of a spectrometer, which allows comparisons to be readily made between samples or with a standard. Moreover, a device for admitting a reference gas contained in a sealed bottle may be provided for comparing it with the sample gas coming from the sublimation tube.

In a first embodiment, the means for introducing the microsample consists of a wire length on which a dry coating of sample was deposited while the heating means consist of a tube accomodating the sample. In a modified embodiment, the means for introducing the microsample and for heating the microsample consists of a same element, namely a cable length having a central wire and a sheath mutually separated by electrically insulating material of mineral nature. The cable length has an end portion of reduced diameter and a welded connection is formed between the wire and the sheath at the end thereof. The end portion of reduced diameter carries the microsample.

In the modified embodiment, the end portion of reduced diameter is heated to the high temperature necessary for transformation of the microsample into a gaseous compound while the balance of the cable length remains at a much lower temperature. The fact that the sample holder is heated to a high temperature over a short length only (typically about 10 mm) results into advantages. Since corrosion takes place in the highest temperature zones only, corrosion is reduced. The device is quite simple since two functions are fulfilled by the cable length. Since the sample holder is of low cost, it may be discarded after each use, thereby overcoming any contamination problem. Cables whose sheath has an appropriate electrical resistance for constituting a heating element when the end portion of the cable length is drawn and reduced in thickness are available in the trade.

The invention will be better understood from reading the following description of particular embodiments given by way of example.

BRIEF DESCRIPTION OF THE DRAWINGS

FIG. 3 is a isometric view of a modified embodiment, some parts being removed for illustrating internal parts and some of the valves being omitted;

FIG. 4 is a vertical cross-section of the reactor and the sublimation tube of one of the four sample introduction sets of the device of FIG. 3.

DETAILED DESCRIPTION OF PREFERRED EMBODIMENTS

Figure 1:
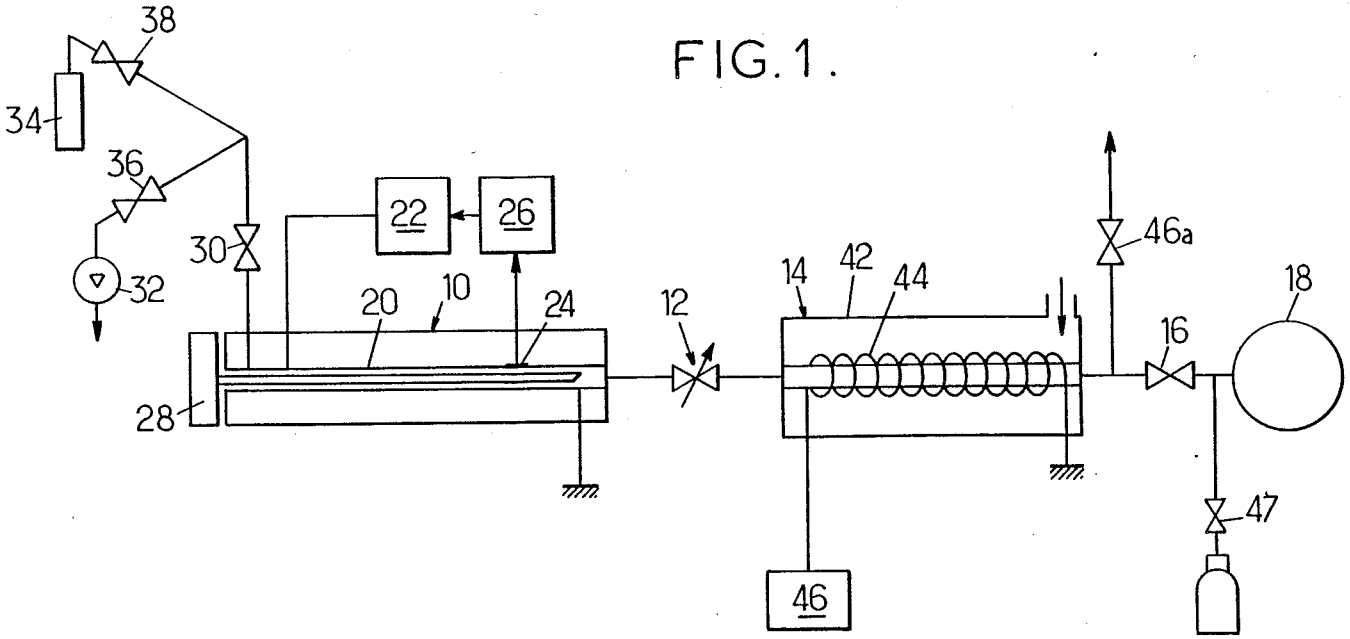
FIG. 1 is a general diagram of the device.
Figure 2:
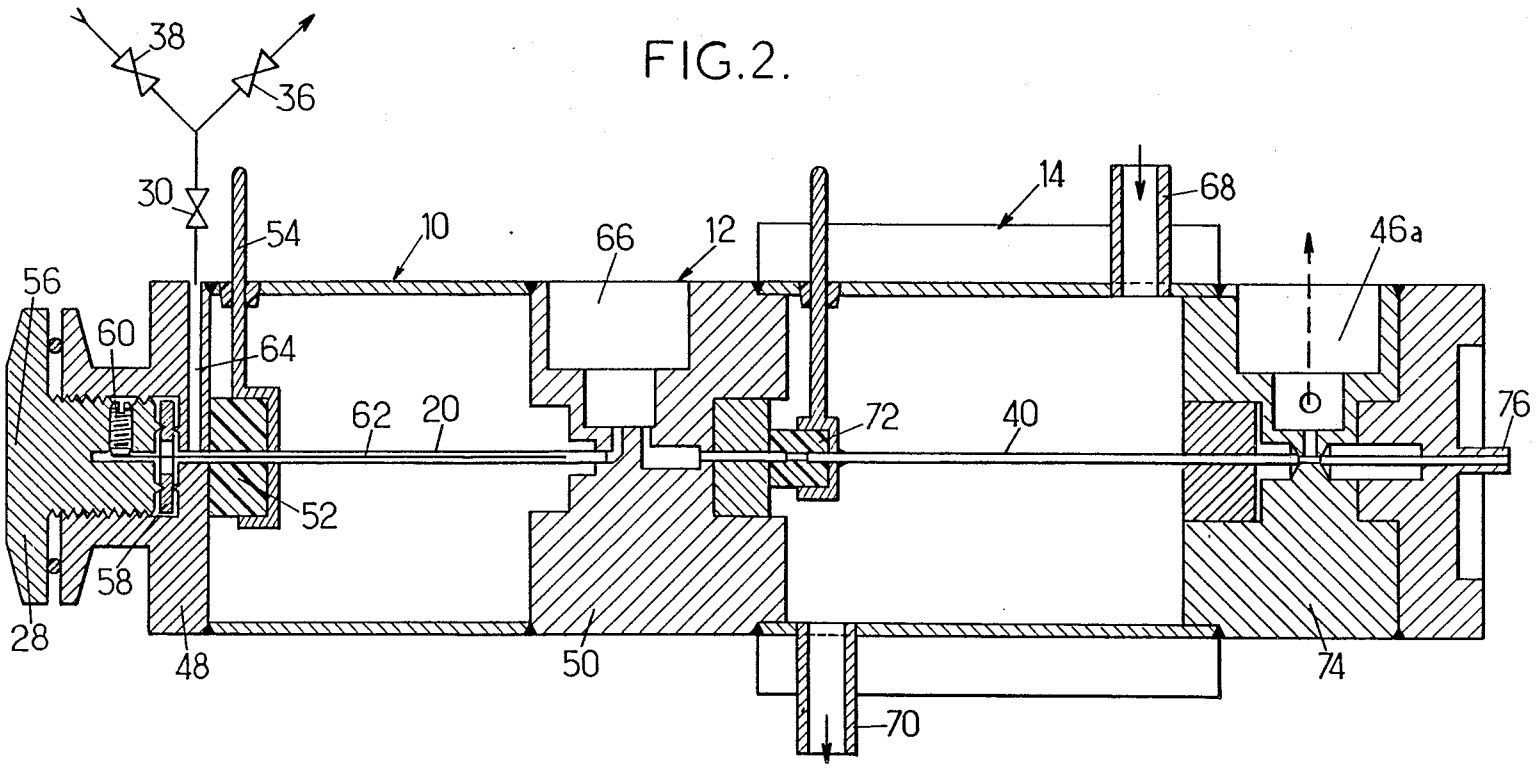
FIG. 2 shows a particular device of the invention, in section through a plane passing through its axis.

The device shown in FIGS. 1 and 2 may be regarded as including a reactor 10 whose essential element is a micro-oven with adjustable temperature, a passage 12 sufficiently restricted for the flow therein to be in the form of a molecular flow, and a microsublimator 14. The microsublimator is connected, through a valve 16, to the ion source 18 of the spectrometer, which may be any one of the types allowing a small gas flow which penetrates therein to be ionized. As a general rule, this source will carry out ionization by electronic bombardment.

The reactor 10 whose general diagram is shown in FIG. 1 includes an enclosure, generally cylindrical, in the axis of which the micro-oven 20 is placed, formed by a tube made from a metal capable of withstanding high temperatures, for example nickel, nichrome, or "monel". Means are provided for heating the oven by an electric current. In FIG. 1, these means are shown in the form of an electric source 22 connected to one end of the tube the end other end of which is grounded. Another solution consists in winding an electric heating resistance about tube 20. This tube may include a temperature sensor 24 connected to a circuit 26 for regulating the temperature by modulating the electric power delivered by source 22. A sample holder 28 is provided for introducing a very small amount of samples, in the form of a deposit on a needle or a wire. The head of this sample holder will be provided for sealingly closing the micro-oven.

One of the ends of tube 20 forming the micro-oven is connected, through a valve 30, to a vacuum source 32 (mechanical primary pump for example) and to a source 34 of reagent, of such a kind that it combines with the sample to form a gaseous or volatile compound. Sources 32 and 34 are each provided with a stop valve 36 and 38. As a general rule, valves 30 and 38 at least must be made from a material withstanding very corrosive gases, since it will frequently be necessary to use very reactive chemical species such as fluorine. Valve 30 must moreover be very air-tight.

The restricted passage 12 may have a fixed flow cross-sectional area. A diaphragm or capillary duct may in this case be used. It may also be adjustable and be formed by a microleak valve of conventional type or a piezoelectric valve, the opening of which is caused by the deformation of a piezoelectric crystal under the action of an electric field. But, in all cases, the passage must prevent any entry of ambient air and it must offer a passage section being of a sufficiently small diameter (typically a few microns) so that the gas flow between the reactor 10 and the microsublimation tube kept at low pressure is a molecular flow. It is known that under these conditions the free path of the gas molecules is greater than the transverse dimensions of the passage.

The microsublimator 14 will generally be formed by a tube 40 of small diameter, one end of which is sealingly connected to passage 12 and the other end of which is connected, through the valve 16, to the ion source 18. This tube is provided with means for cooling to a cryogenic temperature. These means are shown in FIG. 1 in the form of an enclosure 42 having an inlet and an outlet for very low temperature fluid. Another solution consists in placing the tube in the circuit of a cryogenerator. For adjusting the temperature of tube 40, adjustable heating means are associated therewith. In the case of FIG. 1, these means are formed by a heating resistor 44 wound about tube 40 and fed from an electric generator 46 of adjustable power. A temperature probe may be placed on tube 40 for regulating, through a circuit similar to 26, the temperature of the tube to an adjustable value. This temperature may also be maintained at a reference value by the intensity of the ion beams received on the collectors of the mass spectrometer.

For this, a signal is taken from the amplifier measuring the ion current. This latter is permanently compared with a reference representing the chosen temperature, this reference being itself programmed by means of a computer. A voltage is then obtained which is converted into calibrated pulses each delivering a predetermined amount of energy supplying the system heating tube 40.

On each decrease of the measurement signal, a pulse with a corresponding amount of energy is applied to the heating resistor thus regulating the amount of product introduced to the source of the mass spectrometer. In practice, the tube will be brought to a temperature which may vary between a few K and one hundred K.

A valve 46*a*, connected to the output of tube 40 upstream of valve 16, allows the output of tube 40 to be connected to a vacuum pump.

An additional connection having a valve 47 (or several) may be provided for connecting the ion source to a reference gas supply and/or to another device similar to the one which has just been described. In the particular embodiment shown in FIG. 2, elements 10, 12 and 14 of FIG. 1 are grouped together so as to form a single block assembly for several pieces assembled together, for example by welding.

In FIG. 2, where the members corresponding to those of FIG. 1 are designated by the same reference number, the reactor is defined by two end pieces 48 and 50 and a cylindrical casing in the axis of which is placed tube 20, with an inner diameter of a few mm, forming the micro-oven. The downstream end of this tube is grounded through the end piece 50. The upstream end, isolated from the ground by a stud 52, is connected to the electric heating source through the casing. The sample holder 28 includes a head screwable in end piece 48, the sealing being provided by a seal 58. A locking screw 60 provided in the head retains a dry sample supporting wire or needle 62. A channel 64 formed in end piece 48 allows tube 20 to be connected to a reagent intake valve 30 (a gaseous fluorinating agent generally) or to a vacuum pump.

In end piece 50 is machined a seat 66 for receiving the microleak valve (not shown) forming a passage 12 towards the microsublimator 14. This latter has a construction very comparable to that of reactor 10, except that the casing is provided with connections 68 and 70 for the inlet and outlet of cryogenic fluid. The microsublimation tube 40 is connected, through an insulating stud 72, to the end piece 50 and its downstream end is welded to an endpiece 74 having a seat for the valve 46 (not shown).

Finally, this end piece includes a tubular extension for connection to the valve 16.

By way of simple example of using the method of the invention, the introduction of samples will now be described for the isotopic analysis of uranium.

The device used is of the kind shown in FIG. 2.

The sample must first of all be transferred to the sample holder 28. Using a micropipette, a few drops of uranyl nitrate containing for example 10 micrograms of uranium to be analyzed is deposited on wire 62, which has for example a diameter of 0.8 mm and is 7 cm long.

To transform this deposit into a solid phase, the wire is placed between two electric contacts and a heating current is passed through the wire. The uranyl nitrate is transformed into a deposit of $UO_3$, then $U_3O_8$ when the temperature exceeds 350° C.

The wire covered with the deposit is placed in the sample holder 28 and this latter is fixed to the end piece 48. Tube 20 is evacuated by pumping to a pressure of the order of $10^{-3}$ torr. Then tube 20 is heated, by passing a current therethrough, to a temperature of about 400° C., so as to eliminate the residual water proof.

Then the temperature of the microsublimation tube 20 is brought to that of liquid nitrogen by causing liquid nitrogen to flow about tube 40, from connection 68 to connection 70 by flowing a heat carrying gas (helium for example) brought to the temperature of the liquid nitrogen.

Then we pass to the first phase of implementing the method of the invention, formed by trapping gaseous products in the microsublimator 14.

For that, a calibrated flow of very pure fluorine is fed into tube 20, through valves 38 and 30. The products of the reaction ($UF_6$ and $O_2$) escape as a very small flow through valve 20 and are trapped in tube 40, while being distributed in accordance with the solidification temperature.

Once the trapping is finished, valve 12 is closed. The pumping valve 46*a* is opened and tube 40 is heated very progressively by the passage of an electric current. The oxygen is sublimated and it is removed by the vacuum pump through valve 46*a*.

When the temperature increases beyond the sublimation point of oxygen and reaches the sublimation point of hexafluorine, feeding of the ion source may be begun.

For that, valve 46*a* is closed and valve 16 is opened. The heating is carried out with temperature programming such that, as soon as the hexafluorine flow reaches a predetermined value (that is to say when the set value of the intensity of the ion beam in the spectrometer is reached) the temperature is controlled so that the flow, measured by means (not shown), remains constant until the mass of trapped uranium hexafluorine is exhausted. In practice, with a flow of $10^{13}$ molecules per second, the exhaustion takes place in about 30 minutes when 10 micrograms of uranium are deposited on wire 62.

All this time is available for carrying out isotopic ratio measurements, which may then be compared with those of standard uranium hexafluorine, admitted to the spectrometer through valve 47.

Another solution consists in using two devices of the kind shown in FIG. 2. One of them receives a wire carrying a deposit whose isotopic ratio is to be measured, the other a deposit of $U_3O_8$ of known isotopic composition.

It can be seen that whatever the embodiment used, high precision and speed of measurement of a gas source and the low sample mass of a thermo-ionization spectrometer are obtained.

This very low mass in particular allows a device of the invention to be used for analysing irradiated fuels, containing the isotopes of plutonium, the analysis then being conducted on $PuF_6$ formed by fluorination of $PuO_2$.

The invention is however not limited to these particular embodiments. It is applicable whenever a reaction is available giving a gaseous compound of the sample. For example, the method is applicable to the case of carbon, which may be fluorinated so as to give $CF_4$, which is particularly interesting for the isotopic analysis $C_{12}/C_{14}$ used in dating.

Referring to FIGS. 3 and 4, a modified embodiment is illustrated wherein the means for introducing the sample and heating consist of a same component. Those elements of the embodiment of FIGS. 3 and 4 which correspond to those of FIGS. 1 and 2 are designated by the same reference numeral, with the letter a added thereto.

For simplicity, only those components of the device which significantly differ from those of FIGS. 1 and 2 will be described.

The device comprises an air-tight housing 4 consisting of a plurality of mutually connected parts. Threaded holes for receiving valves are formed in the housing. The housing comprises a ring 6, an end piece 7 for connection to the flange 8 (in dash-dot lines) of a ion source and a head 9 which receives a plurality of sample holders, four in the illustrated embodiment. Spacer rods 11 distributed around the ring 6 provide for mechanical resistance of the housing. The ring 6 has a nozzle for connection with a vacuum source 32*a*, typically a turbomolecular pump.

As illustrated in FIG. 3, the device has four sets of means each for introducing and heating a sample. Referring to FIG. 4, each set of means may be considered as including a reactor 10*a*, a restricted passage 12*a* (typically a restrictor having a flow cross-sectional area sufficiently small for the flow to be molecular) and a microsublimator 14*a*. The microsublimator is connected, through a valve 16*a*, to the ion source of the spectrometer which may typically use electron beam ionization.

The reactor is defined by a tubular enclosure 20*a* arranged to receive a sample holder 62 constituting means for introducing and heating a sample. The sample holder is of pin shape and consists of a cable length having a central electrically conducting wire 78 and an electrically conducting sheath 80 separated by a layer of electrically insulating material able to withstand high temperatures, typically of mineral nature. Such cables are available in the trade, for instance under the name "THERMOCOAX". A distal end portion of the sample holder is hammered out, typically over a length 1 of about 10 mm. The sheath is connected to the central wire at the end of the sample holder by a weld. In such a way, a heating zone having a short length 1 is prepared. Corrosion will take place on that part only, since the balance of the sample holder and the internal surface of the tube 20*a* will be at a much lower temperature. A metal flange 82, typically of frustoconical shape and of electrically conducting material such as copper, is fixed to the sheath at a distance from the distal end. The flange, which may be connected by brazing, is arranged for tightly closing an open end of the tube 20*a*. The inner volume of the enclosure may be quite small, since the inner diameter of the tube 20*a* may be as low as 3 mm while the sample holder may be a cable length having a diameter of 1 mm.

The proximal end portion of the sample holder, which projects out of the sealing flange 82, is connected, through an electrically insulating thimble 84, to a connection pin 86 for connection of the wire 78 to an electric power source. Current return may be through the flange 82, the housing and the earth. By passing an electric current in wire 78 and sheath 80, the heating zone 1 may be heated to a temperature exceeding 700° C. if necessary.

Enclosure 20*a* is connected to a tube 88 for connection through a valve 38*a* (FIG. 1) to a header 89 delivering fluorine. Another manually actuated valve 36*a* controls communication between tube 88 and the inner volume of ring 6 provided with the nozzle communicating with the turbomolecular pump 32*a*.

The tube 20*a*, which constitutes a micro-oven, communicates with the microsublimator 14*a* through the restricted passage 12*a* which may be quite short, even if provided with a stop valve (not shown). Consequently, the gaseous compounds resulting from fluorination in the micro-oven 20*a* are not subjected to substantial decomposition before they are trapped in the microsublimator.

As illustrated, the microsublimator 14*a* comprises a low diameter tube aligned with the microoven, provided with means for cooling it to a cryogenic temperature and with controlled heating means.

The cooling means comprise a tubular enclosure 42*a* located coaxially to the sublimation tube and around it. The space between tube 40*a* and enclosure 42 contains a cryogenic fluid selected for being gaseous in the whole temperature range required for trapping the compounds. The gas is typically helium. The enclosures 42*a* of the four sets of introducing means are fed by a same circuit for circulating the cryogenic fluid in gaseous phase. The circuit 90 includes a cooler, schematized on FIG. 4 as a storage of liquid nitrogen 92.

Referring to FIG. 4, the means for bringing each tube 40*a* to a controllable temperature include a heating resistor 44*a* coiled around the tube and fed by an external electric source, through connections 96. A temperature probe (not shown) may be located on tube 40 for delivering a temperature input signal to a servo-loop for controlling the temperature of the tube.

The device of FIGS. 3 and 4 operates along the same line as that of FIGS. 1 and 2. It will be summarized when applied to the isotopic analysis of uranium or plutonium. The samples are typically available as oxides and the fluorination reactions are then:

$$U_3O_8 + 9F_2 \xrightarrow{300^\circ\ C.} 3UF_6 + 4O_2 - 655\ KCal/mole \quad (1)$$

and $$PuO_2 + 3F_2 \underset{}{\overset{700^\circ\ C.}{\rightleftharpoons}} PuF_6 + O_2 - 207\ KCal/mole \quad (2)$$

Reaction (1) may easily be carried out with a yield which is close to 100%. Reaction (2) requires a large fluorine excess. If not, $PuF_6$, which is instable at high temperature, changes to tetrafluoride and fluor. However, the decomposition speed is low if the temperature is lower than 100° C. The device of the invention makes it possible to trap $PuF_6$ on a cold wall a very short time after it has been formed, and the equilibrium of the above equation (2) is displaced to the right. The device makes it possible to remove excess fluor, along with the permanent gases which are possibly present.

Assuming that $U_3O_8$ samples are used, a drop of $U_3O_8$ solution is layered on a new sample holder (not previously used) and dried. Typically, two sample holders having samples to be analyzed and two sample holders carrying standard samples are introduced into respective fluorination ovens 10. The pump 32*a* is used for evacuating the ovens 20*a* through respective valves. Then fluorine is admitted into the ovens, typically under a pressure of about 100 mBars.

The sample holders are heated to a temperature of about 350° C.: fluorination is substantially complete in 2 minutes.

As it is formed, $UF_6$ is trapped in the sublimation tubes 40*a*, whose temperature is lowered to −60° C. by circulating helium at the temperature of liquid nitrogen.

Oxygen formed during fluorination and excess fluor are removed by the pumping system which may consist of a mercury diffusion pump (which also constitutes a chemical trap for fluor). It may be substituted with a turbomolecular pump associated with a chemical trap.

After 2 minutes, the fluorine flow is stopped. Then a selected tube 44*a* may be progressively heated with their resistors 44*a*. As soon as the temperature reaches −80° C., $UF_6$ sublimates and is progressively admitted into the ion source. Temperature control may also be obtained by adjusting the helium pressure within the enclosures 42*a* while delivering a constant electric power to the resistors 44*a* of the tube which is used for delivery to the ion source.

The sublimation temperature may be controlled by a computer, whose input signal is responsive to the ion current. Such an approach makes it possible to stabilize the ion delivery with a very high degree of precision.

As indicated above, a sample and a standard may be introduced in succession. The results are processed by a computer, which may be a multitask computer which also controls the spectrometer.

Numerous modifications are possible. For instance, a calibrated orifice may be located at the output of each sublimation tube for controlling the gas flow toward the ion source. More or less than four tubes may be provided. However, the use of four sets is often optimum: two tubes are used for samples to be analyzed and two tubes are used for samples having isotopic compositions respectively lower than and that of the samples.

We claim:

1. Method for introducing a microsample as gaseous compounds into the ionisation source of a mass spectrometer, comprising the successive steps of:

(a) depositing a microsample in solid form onto a needle-like sample holder;

(b) locating said sample holder in an oven tube in communication with a sublimation tube through a restricted outlet passage;

(c) creating a vacuum in said oven tube and introducing a reactive gas into said oven tube, said reactive gas being selected to react with said sample and to form gaseous compounds at high temperature;

(d) heating said sample holder to a temperature and for a time sufficient to convert said sample into said gaseous compounds while contacting said sublimation tube with a cryogenic fluid for maintaining said sublimation tube at a cryogenic temperature low enough to trap said gaseous compounds;

(e) pumping all gases present in said sublimation tube other than the trapped gaseous compounds out of said sublimation tube;

(f) opening a communication between said sublimation tube and said ionization source; and (g) selectively releasing said gaseous compounds at a controllable rate by controlling the temperature of said sublimation tube.

2. Device for introducing a microsample into the ionization source of a mass spectrometer, comprising:

a reactor having an oven tube, a needle-like sample holder arranged for being inserted into said oven tube through an end opening thereof and to close said end opening when inserted, means for electrically heating said sample holder, means for controlled connection of said oven tube with a vacuum source and means for controlled feeding of an adjustable quantity of a reagent gas into said oven tube, such gas being of such a nature as to transform said sample into gaseous compounds;

a restricted calibrated passage providing an outlet for said gaseous compounds from an end of said oven tube remote from the end closed by said sample holder; and sublimation means having a sublimation tube connected to said oven tube through said passage and connected to said ionization source through valve means, means defining with an outer surface of said sublimation tube a space for receiving a cryogenic fluid and means for controlled electric heating of said sublimation tube.

3. Device according to claim 2, wherein the restricted passage is a diaphragm.

4. Device for introducing a microsample into the ionization source of a mass spectrometer, comprising:

a reactor having an oven tube, a needle-like sample holder arranged for being inserted into said oven tube through an end opening thereof and to close said end opening when inserted, means for controlled electrical heating of said sample holder, first valve means for connection of said oven tube with a vacuum source and second valve means for feeding an adjustable quantity of fluorine into said oven tube;

a restricted calibrated passage originating from an end of said oven tube remote from the end closed by said sample holder and of such cross-section that gas flow therealong is molecular; and sublimation means having a sublimation tube having a proximal end connected to said oven tube through said passage and a distal end connected to said ionization source, third valve means for controlled connection of said distal end with a vacuum pump, wall means defining with an outer surface of said sublimation tube a space for receiving a cryogenic fluid and means for controlled electric heating of said sublimation tube.

5. Device according to claim 4, wherein said oven tube and sublimation tube are located coaxially and in alignment.

6. Device according to claim 4, wherein said cryogenic fluid is helium in gas form maintained at the temperature of liquid nitrogen.

7. Device for introducing a microsample into the ionization source of a mass spectrometer, comprising:

a reactor having an oven tube, needle like sample holding and heating means having a cable length consisting of a central conducting wire, a sheath, and mineral insulating material separating said wire and sheath, said cable length having a lengthened distal end portion of reduced diameter terminated by a junction between the wire and sheath, said lengthened end portion for receiving a microsample and comprising a flange for tightly closing the oven tube, means for connecting said oven tube with a vacuum source, means for delivery of an adjustable flow of a gaseous reactant for transforming a microsample into gaseous compounds;

a restricted calibrated passage providing an outlet for said gaseous compounds from an end of said oven tube remote from the end closed by said flange;

sublimation means having a sublimation tube connected to said oven tube through said passage and connected to said ionization source through valve means, means defining with an outer surface of said sublimation tube a space for receiving a cryogenic fluid and means for controlled electric heating of said sublimation tube.

8. Device according to claim 7, wherein said flange is of frustoconical shape.

9. Device according to claim 7, wherein said distal end portion has a length of about 10 mm.

10. Device according to claim 7, comprising a plurality of identical sets each consisting of separate sample holding and heating tube and sublimation means, the spaces around all said sublimation means being connected to a common helium circulation circuit including a cryogenic cooler for bringing said helium to a cryogenic temperature.

* * * * *